United States Patent [19]

Klaucke et al.

[11] Patent Number: 4,570,849

[45] Date of Patent: Feb. 18, 1986

[54] FAN DRIVE, PARTICULARLY FOR COOLING INSTALLATION OF VEHICLES

[75] Inventors: Thomas Klaucke, Renningen; Franz Pigisch, Ditzingen, both of Fed. Rep. of Germany

[73] Assignee: Sueddeutsche Kuehlerfabrik Julius Fr. Behr GmbH & Co. KG, Stuttgart, Fed. Rep. of Germany

[21] Appl. No.: 672,206

[22] Filed: Nov. 16, 1984

[30] Foreign Application Priority Data

Nov. 19, 1983 [DE] Fed. Rep. of Germany ..... 3341795

[51] Int. Cl.[4] ..... F01P 7/02

[52] U.S. Cl. ..... 236/35; 91/419; 91/452; 165/39; 251/44; 417/46

[58] Field of Search ..... 236/35; 251/44; 417/32, 417/46; 165/39; 91/419, 452; 123/41.12

[56] References Cited

U.S. PATENT DOCUMENTS

| | | | |
|---|---|---|---|
| 2,673,706 | 3/1954 | Matteson | 251/44 X |
| 2,758,811 | 8/1956 | Peterson | 251/44 X |
| 2,893,680 | 7/1959 | Freund | 251/44 X |
| 3,118,648 | 1/1964 | Campbell | 236/35 X |
| 3,198,204 | 8/1965 | Parks | 251/44 X |
| 3,297,047 | 1/1967 | Sime | 251/44 X |
| 3,415,269 | 12/1968 | Salerno | 251/44 X |
| 3,664,129 | 5/1972 | Schwab | 91/419 X |
| 4,009,860 | 3/1977 | Lingnau | 251/44 |
| 4,065,052 | 12/1977 | Ridenour | 236/35.3 X |
| 4,283,009 | 8/1981 | Deem | 123/41.12 X |

FOREIGN PATENT DOCUMENTS 3222851 12/1983 Fed. Rep. of Germany .

*Primary Examiner*—William E. Tapolcai

*Attorney, Agent, or Firm*—Schwartz, Jeffery, Schwaab, Mack, Blumenthal & Evans

[57] ABSTRACT

Disclosed is a fan drive, in particular one for cooling installations of rail vehicles. The fan drive comprises a hydraulic motor and a control valve which regulates a bypass as a function of temperature, thus affecting the flow of a pressure medium driving the motor. The control valve comprises a control piston subjected to a control pressure in the direction of closing the bypass, and a counterbalancing pressure in the opposite direction from the source of the pressure medium. The control valve also comprises a control spring which biases the control piston in the direction of closing the valve, and a pilot valve which affects the control pressure. The pilot valve is actuated by an electromechanical servo component. The pilot valve is located in an insert which is arranged within the control piston. A central bore of the control piston is slidingly guided on the convex surface of the insert so as to form a seal.

20 Claims, 4 Drawing Figures

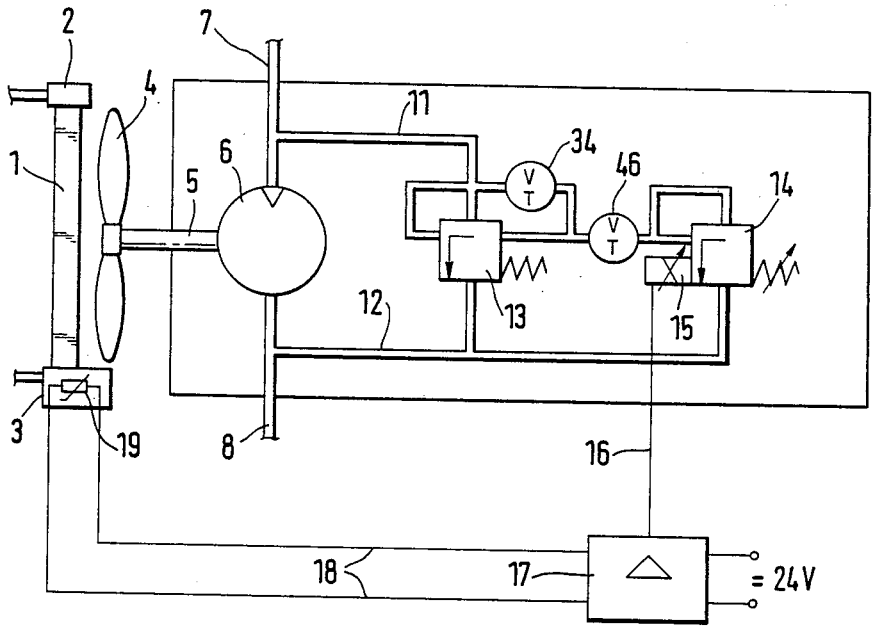
FIG. 1
FIG. 4
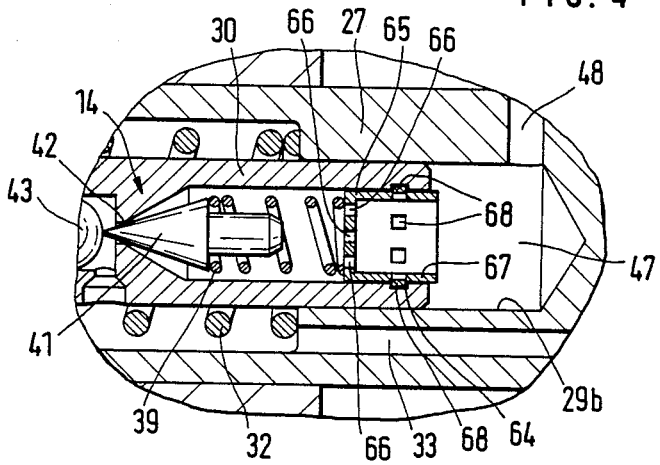

FAN DRIVE, PARTICULARLY FOR COOLING INSTALLATION OF VEHICLES

BACKGROUND OF THE INVENTION

The invention relates to a fan drive, particularly one for cooling installations of vehicles.

More particularly, the invention relates to a fan drive which comprises a hydraulic motor, a control valve which regulates the flow of pressure medium through a bypass around the hydraulic motor as a function of the temperature, a control valve, a control spring which biases the control piston in the direction of closing the bypass, a control pressure in the control chamber which also acts on the control piston in the direction of closing the bypass, and a pilot valve which regulates the control pressure and which is actuated by an electromechanical servo element.

A fan drive of this general type is disclosed in German application No. P 32 22 851. A sensitive control of the fan drive is obtained with the installation described in the aforecited application. A very simple configuration of the fan drive is ensured, in particular, by integration of parts and a small number of hydraulic connecting lines. Furthermore, this variable fan drive is universally applicable to different arrangements of hydrostatically driven fan wheels.

SUMMARY OF THE INVENTION

It is an object of the present invention, to provide an improved fan drive of the type set forth above so as to achieve a construction requiring less space and consisting of the lowest number of inexpensively produceable individual parts.

It is also an object of the present invention to provide a fan drive which reacts rapidly to even slight variations of a reference valve.

Another object of the present invention is to provide a fan drive which eliminates unnecessary operation of the fan or its running at excessively high rotational speeds so that energy savings may be achieved.

It is a further object of the present invention to provide a fan drive with an extremely short structural length.

Another object of the present invention is to provide a fan drive which does not require an oil leakage line, i.e., to provide a fan drive suited for gear motors or other drives not requiring oil leakage lines, or for connecting a series of drives.

Another object of the present invention is to provide a fan drive in which electrical power is required only for changing the settings.

A further object of the present invention is to provide a fan drive with the highest degree of integration possible.

Another object of the invention is to ensure that the fan motor will continue to operate independently of the temperature in case of a malfunction of the electrical installation.

In accomplishing the foregoing objects according to the invention, there has been provided a fan drive, particularly for a cooling installation of a rail vehicle, comprising a hydraulic motor which is actuated by a pressure medium; a bypass for detouring the flow of pressure medium around the hydraulic motor; control valve which regulates the flow of pressure medium to the bypass and to the hydraulic motor, this control valve comprising a control piston for opening and closing the bypass and having a central bore, an insert upon which the central bore of the control piston is slidingly arranged so as to form a seal, a front surface of the control piston facing the direction of closing the bypass which is acted upon by the pressure medium, a back surface of the control piston facing away from the direction of closing the bypass which is also acted upon by the pressure medium wherein the pressure acting on the front side of the control piston is the full pressure of the pressure medium called the high-pressure, and the pressure of the pressure medium acting on the back side of the control piston is called the control pressure, a control spring for biasing the control piston in the direction of closing the bypass, and a control cylinder for slidably containing the control piston which is divided by the piston into a high-pressure section in front of the front surface and a control chamber in back of the back surface; a pilot valve, arranged in the insert, which functions to regulate the control pressure; and an electromechanical servo element for actuating the pilot valve.

Further objects, features and advantages of the present invention will become apparent from the detailed description of preferred embodiments which follows, when considered together with the attached figures of drawing.

BRIEF DESCRIPTION OF THE DRAWINGS

In the drawings:

FIG. 1 shows a block circuit diagram of a control circuit according to the present invention;

FIG. 4 shows an alternative embodiment with reference to FIG. 2.

DETAILED DESCRIPTION OF PREFERRED EMBODIMENTS

Figure 2:
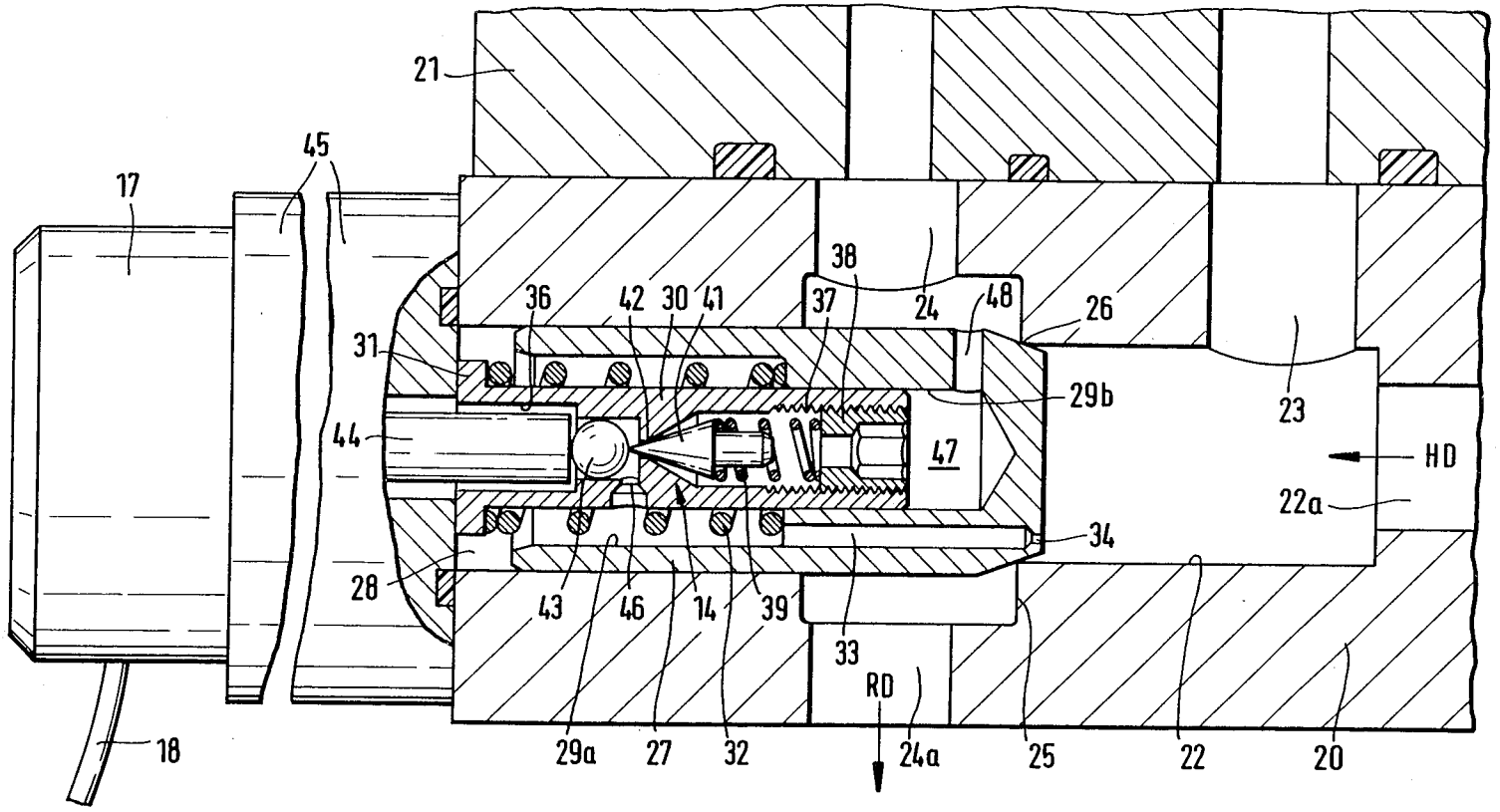
FIG. 2 shows a motor connector plate with an integrated control valve in the form of a seat valve.

Essential advantages of the invention are to be found in that the control valve of the fan drive consists of simple parts that may be produced inexpensively and installed readily and in that, as the result of the placement of a pilot control valve within a control piston, very little installation space is required. The control valve makes possible a regulation which reacts rapidly to even slight variations of the reference value. The fan drive according to the invention is suitable for different hydrostatic drives, particularly also for the fans of electric traction motors. By means of the regulated fan drive and the sensitive controls, the unnecessary operation of the fan and/or its running at excessively high rotational speed are prevented. This leads to a substantial savings of energy.

A preferred further development of the invention comprises supporting a control spring on an insert piece, with an end away from a control piston. In this manner, a separate fastening of the insert piece is not necessary, because the insert piece is held on a wall section of the electromechanical servo component by a pretensioning of the spring. A control valve which regulates the bypass is appropriately in the form of a seat valve, in which the surface area of a control piston exposed to an advancing pressure is equal to the surface area exposed to a control pressure. This configuration results in an extremely short structural length. A variant of an embodiment of the present invention comprises a control valve in the form of a slide valve which regulates the bypass. In this case as well, the surface areas exposed to a advancing pressure and the control pressure are equal. In order to create this ratio of surface areas in the case of a slide valve, it is advisable that the center bore extend over the entire axial length of the control piston and that the insert piece protrude through said bore.

A further substantial advantage of the invention is that an oil leakage line is not necessary. For this purpose, the surfaces exposed to a back pressure in the opening or closing direction of the control valve, respectively, are counterbalanced. Because it is not necessary for the pressure medium to escape from the pilot valve to an oil leakage line, but may pass directly to the return line, the control valve is particularly suited for gear motors or other drivers not requiring oil leakage lines, or for connecting a series of drives.

A control magnet or a step motor may be provided as the electromechanical servo component. The use of a step motor has the advantage that electric power is required only for changing the settings.

In order to obtain a particularly simple construction of the pilot valve, the latter comprises essentially a valve cone, a valve seat and a spring loading the valve cone. The tip of the valve cone interacts with a ball, whereby the valve cone may be lifted from the valve seat. In order to be able to set a predetermined opening pressure, the spring force biasing the valve cone of the pilot valve is adjustable. A regulating screw or a fixable support element which may be slidably introduced into any desired position may be provided for adjustment. The latter has the advantage that during the installation of the pilot valve the force of the spring may be measured, thereby eliminating subsequent adjustments.

In order to avoid extreme variations of pressure in the control chamber and the resulting pressure impacts in the fan motor, it is advisable to connect the control chamber with an advance line of the motor by means of a first choke and with the control valve by means of a second choke. To obtain the highest degree of integration possible, the control piston and the pilot valve may be arranged in a connector plate of the hydraulic motor. In order to insure that the fan motor will keep on operating independently of the cooling temperature in case of a malfunction of the electrical installation, it is advantageous for the pilot valve to assume its closed position when an electronic circuit of the elecromechanical servo element, respectively, is without current.

FIG. 1 shows a radiator 1 with tanks 2 and 3, associated with an axial fan 4. The axial fan 4 is located on a shaft 5 of a hydraulic motor 6. In this example, the hydraulic motor 6 is a gear motor, connected with a high-pressure carrying advance line 7 and a back-pressure carrying return line 8 of a hydraulic circuit. A spring loaded check valve 13 is inserted in a bypass line 11, 12. The switching with the chokes 34 and 46 and the mode of operation of the check valve 13 shall be explained in detail below with reference to FIGS. 2 and 4. A pilot valve 14, activated by an electromechanical servo element 15 is provided for actuating the check valve 13. On the outlet side, the valves 13 and 14 are connected with the return line 8. The electromechanical servo element 15 is connected with the outlet terminal of an electronic controller 17 by means of a control line 16. A temperature sensor 19, located in a water tank 3 of a radiator 1, is connected with the inlet terminals of the controller 17 by means of control lines 18.

When the temperature of the cooling water of the radiator 1 is very low, the temperature sensor 19 has a low electrical resistivity so that the electronic controller 17 receives a high input signal. This results in a corresponding current or pulse sequence being passed to the electromechanical servo element 15 in order to bring the armature of the electromechanical servo element 15 into the proper position. The pilot valve 14 is thereby placed into its open position, and the compression forces acting on the check valve 13 are affected in such a manner that the resulting pressure force overcomes the force of the control spring in the opening direction of the valve. The bypass line 11, 12 is thus connected. The fan motor 6 is thereby bridged by the bypass line 11, 12 so that the flow of the pressure medium in the advance line 7 affects the fan motor 6 not at all or only slightly.

The resistance characteristic of the temperature sensor 19 also changes as the cooling water is increasingly heated, resulting in a change in the input value of the electronic controller 17. The output signal of the electronic controller 17 changes correspondingly, resulting in an effect on the electromechanical servo element 15. The pilot valve 14 is thus set at a smaller passage cross section. This setting of the pilot valve 14 affects the pressure conditions at the valve closing element of the check valve 13 in such a manner that the passage cross-section of the valve 13 is also reduced. As a result of the decreased flow of the pressure medium in the bypass line 11, 12, the proportion of the pressure medium stream impacting the fan motor 6 increases. The fan motor 6 thus drives the axial fan 4 at a corresponding rotational speed.

If a predetermined upper limiting value of the cooling water temperature is attained, the input signal of the electronic cotroller 17 becomes so small as a result of the high resistance value of the temperature sensor 19, that the output signal of the controller brings the electromechanical servo element 15 to its end position. The pilot valve 14 is thus completely closed. In this case, equal pressure is built up on both sides of the valve closing element of the check valve 13. This pressure is built-up in the closing direction with a time delay so that the check valve 13 is closed. As the bypass line 11, 12 is now blocked, the fan motor 6 is subjected to the entire flow of the pressure medium, and the axial fan 4 is operated with a maximum rotational speed.

In case of the use of a fan drive for an electric traction motor, the axial fan 4 would be coordinated with an electric machine. The temperature sensor 19 is then integrated with the motor winding. The prevailing temperature of the winding determines the position of the pilot valve 14 and thus the rotational speed of the fan as the input valve of the electronic controller 17.

FIG. 2 shows a connector plate 20 of a hydraulic motor 21. The connector plate 20 has a bore 22 which is arranged at right angles to two axially distant bores, a bore 23 carrying high pressure (HD) and a bore 24 carrying a backpressure (RD). The connection carrying the high pressure (HD) of the advance line is designated **22*a* and the connection carrying the backpressure (RD) of the return line is 24*a*. A shoulder 25 is provided in the bore 22 between the bore 23 and the bore 24, the internal radius of which serves as the valve seat 26 of the check valve. A control piston 27 is sealingly guided in the bore 22 and rests against the valve seat 26. The control piston has an essentially cup-like configuration and defines a control chamber 28 with its side facing away from the valve seat 26**.

The control piston 27 has a stepped central bore 29*a*, 29*b*, in which the section 29 forms part of the control chamber 28. The radial surface limiting the control chamber 28 is equal to the surface of the control piston 27 which is exposed to the high pressure (HD). An insert 30 is guided in a pressure medium-tight manner in the bore section 29*b*, i.e., the control piston 27 is slidably held on the convex surface of the insert 30. The insert 30 has a radial collar 31 supporting one end of a control spring 32, on its end facing away from the control piston 27 and rests against the shoulder of the bore 29*a*, 29*b* with its other end. The control piston 27 is thereby loaded against the valve seat 26. An axial bore 33 with a choke 34 is provided in the control piston 27 outside the bore section 29*b*. The choke 34 connects the section of the bore 22 located in front of the check valve with the control chamber 28.

The insert 30 has a central, multistep bore 36, extending over its entire length. The end of the bore 36 to the right in FIG. 2 is provided with threads 37, into which a hollow bolt 38 is screwed. A spring 39, which loads a valve cone 41 against a valve set 42, is supported against the hollow bolt 38. The valve cone 41 and the valve seat 42 form the essential parts of the pilot valve 14. The tip of the valve cone 41 is supported against a ball 43 located on the right hand side in the bore 36, and in turn interacts with a tappet 44 of a control magnet 45. The electronic controller 17 is structurally integrated with the control magnet 45.

The section of the bore 36 in which the ball 43 is located and the bore section 29*a* which is a component of the control chamber 28, are connected with each other by means of a choke 46. The choke 46 has the function of preventing the upward motion of the two elastically supported elements, the control piston 27 and valve cone 41. The space of the bore section 29*b*, which is bordered by the insert 30 forms a pressure outlet chamber 47 which is connected by a radial bore 48 with the bore 24 carrying the backpressure (RD).

The mode of operation of the control valve shown in FIG. 2 shall be described as follows, in which the moving parts of the control valve assume the positions they would have when the overall installation is in a state without pressure and power.

When pump pressure is introduced in the bore 22, the control piston 27 is exposed to said pressure in the opening direction of the bypass. As a result of the choke bore 34, a counter pressure is built up in the control chamber 28, which corresponds to the pressure prevailing on the right hand side of the control piston 27. Because of the equal pressures and equal surface areas exposed to pressure, the control spring 32, acting as the resultant force, holds the control piston 27 against the valve seat 26 and thereby keeps the bypass closed. The hydraulic motor 21 is then subjected to the entire flow of the pressure medium, and the fan is operated at its maximum rotational speed. Because of a corresponding signal from the temperature sensor in the cooling water, the coil of the control magnet 45 is excited, and the valve cone 41 is raised by the ball 43 from the valve seat 42. The pressure medium is then able to flow through the open pilot valve 14 into the outlet chamber 47, and from there through the bore 48 into the return connection 24*a*. The reduction of the pressure in the control chamber 28 leads to the displacement of the control piston 27 against the control spring 32, thereby opening the bypass between the bores 23 and 24. The extent to which the passage cross section of the bypass is opened is a function of the opening cross section of the pilot valve 14 which affects the reduction of pressure in the control chamber 28.

As pressure medium is continuously supplied through the choke bore 34 from the high pressure side in the control chamber 28, a corresponding amount must be removed through the pilot valve 14 to maintain the control piston 27 in a certain control position. If the control magnet 45 is without power, as in the case of high cooling water temperatures or during a failure of the electric installation, the spring 39 moves the valve cone 41 against the valve seat 42, thereby closing the pilot valve 14. The pressure in the control chamber 28 is thus maintained at its highest value, and the control piston 27 is kept in the closed position.

Figure 3:
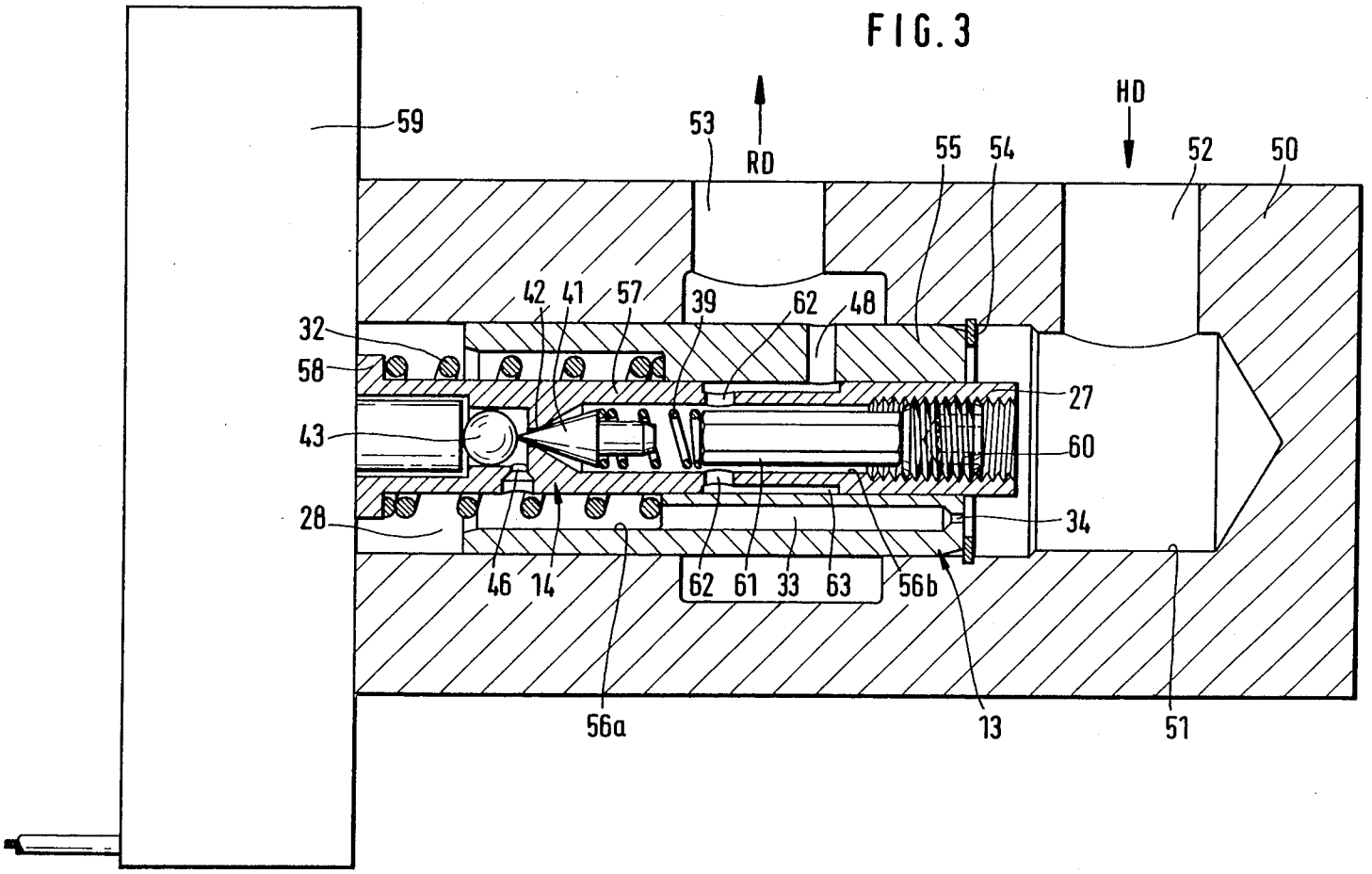
FIG. 3 shows a control valve in the form of a slide valve.

FIG. 3 shows the arrangement of the check valve 13 and the pilot valve 14 in a housing 50. The housing may be provided separately or structurally integrated with a hydraulic motor. The housing 50 has a bore 51 which is at right angles to two vertically spaced bores, a bore 52 connected with the high pressure (HD) and a bore 53 connected with the backpressure (RD). A retainer ring 54 is inserted in the bore 51 and between the bores 52 and 53. A substantially annular control piston 55 is guided sealingly in the bore 51. The control piston abuts the side of the retainer ring 54 facing the bore 53, and defines a control chamber 28 with its side facing away from the retainer ring 54. The radial surface of the control piston 55 bordering the control chamber 28 is equal in size to the surface area exposed to the high pressure (HD).

The control piston 55 has a stepped center bore 56*a*, 56*b*, with the section 56*a* being part of the control chamber 28. An insert 57 is guided in the bore section 56*b* in a pressure medium-tight manner, i.e., the control piston 55 is slidably supported on the convex surface of the insert 57. The insert 57 extends through the entire control piston 55 and protrudes on the high pressure side. The insert 57 has a radial collar 58 at its end facing away from the control piston 55. The collar 58 lies against a housing of a step motor 59. A control spring 32 rests against the radial collar 58 and the shoulder of the bore 56*a*, 56*b*, with its other end thereby loads the control piston 56 against the retainer ring 54. An axial bore 33, located in the control piston 55 outside the bore section 56*b*, whereby the part of the bore 51 in front of the check valve with the control chamber 28.

The parts surrounding the pilot valve 14 are similar in configuration to those in FIG. 2. for this reason, the same reference symbols are used. A stud bolt 60 is screwed into the thread 37. A spacer 61, which supports the spring 39, is arranged on the side of the stud bolt facing the pilot valve. The spring 39 in turn loads the valve cone 41. The spacer 61 is constructed so that it permits the passage of the hydraulic fluid to the radial orifices 62. The radial orifices 62 open into an annular space 63 on the circumferential surface of the insert 57. The annular space 63 is in turn connected with the bore 53 by means of a radial bore 48 in the control piston 55. As seen in FIG. 3, the control piston 55 has no surface effectively exposed to the backpressure.

The mode of operation of the control valve as shown in FIG. 3 is similar to that described by FIG. 2. The changes are merely of a structural nature, i.e., the control valve is a slide valve and the electromechanical servo element is a step motor 59.

FIG. 4 shows a variant of the embodiment of the pilot valve of FIG. 2. Parts that are identical with those in FIG. 2, are signified by identical reference numerals. The end of the insert adjacent to the pressure outlet chamber 47 has only an annular groove 64 in place of threads. A support element 65 is located in the insert 30. The support element 65 comprises a sheet metal cup, the bottom of which supports the spring 39. Several orifices are arranged in the bottom of the support element 65, the total cross section of which is larger than that of the pilot valve 14. The support element 65 has a plurality of projections 68 on its cylindrical wall 67. The projections engage the groove 64 of the insert 30.

The advantage of this arrangement is that the force of the spring 39 acting on the valve cone 41 may be adjusted in a simple manner without any pressure testing during the installation of the pilot valve. Accordingly, the support element 65 is displaced in the direction of the valve cone 41 and the spring 39 is loaded. The force acting on the support element 65 is measured in this manner. When the tension desired of the spring 39 is obtained, a plurality of outwardly directed projections 68 is produced by means of appropriate implements, by shearing, for example. Said projections engage the groove 64 of the support element 30. Pressure testing to determine the opening pressure and subsequent adjustment of the spring 39 are not required.

In all of the embodiments, the pilot valves 14 are in the form of analog valves and are regulated by the electromechanical servo components, e.g., electromagnet 45, and step motor 59. The armature or spindle stroke, respectively, of the electrochemical servo components vary as a function of the prevailing output signal of the electronic controller 17. In this manner, when the temperature of the cooling water remains constant over an extended period of time and, therefore, the rotational speed of the fan is kept constant, the pilot valve remains in its position and is not required to perform a multitude of switching processes.

What is claimed is:

1. A fan drive suitable for a cooling installation of a vehicle, comprising:

(a) a hydraulic motor which is actuated by a pressure medium;

(b) a bypass for detouring the flow of pressure medium around the hydraulic motor;

(c) a control valve which regulates the flow of pressure medium to the bypass and to the hydraulic motor wherein said control valve comprises a control piston for opening and closing said bypass and having a central bore, an insert upon which the central bore of the control piston is slidingly arranged so as to form a seal, a front surface of the control piston facing the direction of closing said bypass which is acted upon by the pressure medium, a back surface of the control piston facing away from the direction of closing said bypass which is also acted upon by the pressure medium wherein the pressure acting on the front side of the control piston is the full pressure of the pressure medium called the high-pressure, and the pressure of the pressure medium acting on the back side of the control piston is called the control pressure, a control spring for biasing the control piston in the direction of closing said bypass, and a control cylinder for slidably containing the control piston which is divided by said piston into a high-pressure section in front of said front surface and a control chamber in back of said back surface;

(d) a pilot valve, arranged in said insert, which functions to regulate said control pressure; and (e) an electromechanical servo element for actuating said pilot valve.

2. A fan drive according to claim 1, wherein said control spring is supported on its side facing away from the control piston by the insert.

3. A fan drive according to claim 1, wherein the control valve is in the form of a seat valve.

4. A fan drive according to claim 1, wherein the control valve is in the form of a slide valve.

5. A fan drive according to claim 1, wherein said central bore extends over the entire length of the control piston, and wherein the insert projects through said central bore.

6. A fan drive according to claim 1, wherein the high pressure and the control pressure are counterbalanced.

7. A fan drive according to claim 1, wherein the electromechanical servo element comprises a control magnet.

8. A fan drive according to claim 1, wherein the electromechanical servo element comprises a step motor.

9. A fan drive according to claim 1, wherein the pilot valve is an analog valve, and wherein said pilot valve comprises:

a valve cone having a tip;

a valve seat onto which the valve cone fits so as to make a seal;

a coil spring for biasing the valve cone against the valve seat; and a ball which interacts with the tip of the valve cone so as to lift the valve cone from the valve seat.

10. A fan drive according to claim 9, wherein the biasing force of the coil spring may be adjusted.

11. A fan drive according to claim 10, further comprising a screw for adjusting the biasing force of the coil spring.

12. A fan drive according to claim 10, further comprising a slidably introducable support element, which may be immobilized in any desired position and which serves to adjust the biasing force of the coil spring.

13. A fan drive according to claim 1, further comprising a first choke which connects the high-pressure section of said control cylinder with said control chamber; and a second choke which has a cross-section greater than the cross-section of the first choke and which connects said control chamber with said pilot valve.

14. A fan drive according to claim 1, wherein the control piston and the pilot valve are disposed in a connector or closure plate of a hydraulic motor.

15. A fan drive according to claim 1, wherein the hydraulic motor is a gear motor.

16. A fan drive according to claim 1, wherein the pilot valve is in its closed position when said electromechanical servo element is without power.

17. A fan drive according to claim 1, wherein said fan drive is incorporated into a liquid cooling system, and wherein said electromechanical servo element is actuated according to the temperature of a cooling medium in the liquid cooling system.

18. A fan drive according to claim 1, wherein said fan drive is incorporated into the cooling system of an electrical motor, and wherein said electromechanical servo element is actuated according to the temperature of an electrical motor winding.

19. A fan drive according to claim 3, wherein the surface area of said front surface exposed to pressure is equal to the surface area of said back surface exposed to pressure.

20. A fan drive according to claim 4, wherein the surface area of said front surface exposed to pressure is equal to the surface area of said back surface exposed to pressure.

* * * * *